US010756433B1

(12) United States Patent
Channabasappa et al.

(10) Patent No.: US 10,756,433 B1
(45) Date of Patent: Aug. 25, 2020

(54) DUAL-BAND ANTENNA FOR PERSONAL AREA NETWORK (PAN) AND WIRELESS LOCAL AREA NETWORK (WLAN) RADIOS

(71) Applicant: Amazon Technologies, Inc., Seattle, WA (US)

(72) Inventors: Eswarappa Channabasappa, Milpitas, CA (US); Amit Gaikwad, Fremont, CA (US)

(73) Assignee: Amazon Technologies, Inc., Seattle, WA (US)

( * ) Notice: Subject to any disclaimer, the term of this patent is extended or adjusted under 35 U.S.C. 154(b) by 2 days.

(21) Appl. No.: 16/284,271

(22) Filed: Feb. 25, 2019

(51) Int. Cl.

| | |
|---|---|
| ***H01Q 5/20*** | (2015.01) |
| ***H01Q 1/27*** | (2006.01) |
| ***H01Q 1/24*** | (2006.01) |
| ***H01Q 5/371*** | (2015.01) |
| ***H01Q 5/47*** | (2015.01) |
| ***H01Q 5/15*** | (2015.01) |
| ***H01Q 5/28*** | (2015.01) |

(52) U.S. Cl.
CPC ..... *H01Q 5/371* (2015.01); *H01Q 1/243* (2013.01); *H01Q 1/273* (2013.01); *H01Q 5/15* (2015.01); *H01Q 5/20* (2015.01); *H01Q 5/28* (2015.01); *H01Q 5/47* (2015.01)

(58) Field of Classification Search
CPC ..... H01Q 1/243; H01Q 21/30; H01Q 5/371; H01Q 13/10; H01Q 1/2283; H01Q 1/2291; H01Q 1/246; H01Q 5/10; H01Q 5/30; H01Q 5/307; H01Q 5/328; H01Q 5/357; H01Q 9/04; H01Q 9/065; H01Q 9/40; H01Q 5/15; H01Q 5/28; H01Q 5/47; H01L 2224/131; H04B 1/005; H04B 1/0057; H04B 1/0064; H04B 7/0602; H04B 7/0608; H04B 7/0802; H04W 84/12
See application file for complete search history.

(56) References Cited

U.S. PATENT DOCUMENTS

| | | | | |
|---|---|---|---|---|
| 6,268,831 | B1 * | 7/2001 | Sanford | H01Q 1/243 343/700 MS |
| 6,515,629 | B1 * | 2/2003 | Kuo | H01Q 1/38 343/700 MS |
| 6,995,720 | B2 * | 2/2006 | Shikata | H01Q 9/0421 343/700 MS |
| 7,106,257 | B2 * | 9/2006 | Liu | H01Q 1/22 343/700 MS |
| 7,113,133 | B2 * | 9/2006 | Chen | H01Q 1/243 343/700 MS |
| 7,286,087 | B1 * | 10/2007 | Lee | H01Q 1/2258 343/700 MS |
| 7,388,550 | B2 * | 6/2008 | McLean | H01Q 1/38 343/725 |
| 7,417,588 | B2 * | 8/2008 | Castany | H01Q 1/22 343/700 MS |
| 7,865,150 | B2 * | 1/2011 | McFarland | H03H 7/0153 370/338 |

(Continued)

*Primary Examiner* — Vibol Tan
(74) *Attorney, Agent, or Firm* — Lowenstein Sandler LLP

(57) ABSTRACT

Antenna structures and methods of operating the same of a dual-band antenna of an electronic device are described. One device includes a single RF feed line coupled to a dual-band antenna. The dual-band antenna includes a ground element, a first arm, a shorting arm, a dual-arm structure, and a dual-element structure.

20 Claims, 7 Drawing Sheets

(56) References Cited

U.S. PATENT DOCUMENTS

| | | | | |
|---|---|---|---|---|
| 8,207,895 | B2 * | 6/2012 | Wong | H01Q 1/243 343/700 MS |
| 8,922,448 | B2 * | 12/2014 | Wong | H01Q 1/521 343/841 |
| 9,065,175 | B2 * | 6/2015 | Corbin | H01Q 1/243 |
| 9,123,990 | B2 * | 9/2015 | Ramachandran | H01Q 1/243 |
| 9,385,795 | B1 * | 7/2016 | Ananthanarayanan | H04L 5/08 |
| 9,484,631 | B1 * | 11/2016 | Napoles | H01Q 1/243 |
| 9,502,750 | B2 * | 11/2016 | Yarga | H01Q 1/243 |
| 9,647,337 | B1 * | 5/2017 | Kuo | H01Q 5/328 |
| 9,653,821 | B1 * | 5/2017 | Obeidat | H01Q 21/30 |
| 10,027,023 | B1 * | 7/2018 | Kim | H01Q 1/273 |
| 10,109,918 | B2 * | 10/2018 | Thill | H01Q 11/10 |
| 10,499,282 | B1 * | 12/2019 | Kamath | H04W 48/20 |
| 10,609,620 | B1 * | 3/2020 | Wong | H04W 40/08 |
| 2004/0127185 | A1 * | 7/2004 | Abrahams | H04B 1/005 455/277.1 |
| 2009/0278745 | A1 * | 11/2009 | Huang | H01Q 9/0421 343/700 MS |
| 2018/0351244 | A1 * | 12/2018 | McAuliffe | H01Q 1/44 |
| 2020/0059010 | A1 * | 2/2020 | Yang | H01Q 1/48 |

* cited by examiner

DUAL-BAND ANTENNA FOR PERSONAL AREA NETWORK (PAN) AND WIRELESS LOCAL AREA NETWORK (WLAN) RADIOS

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
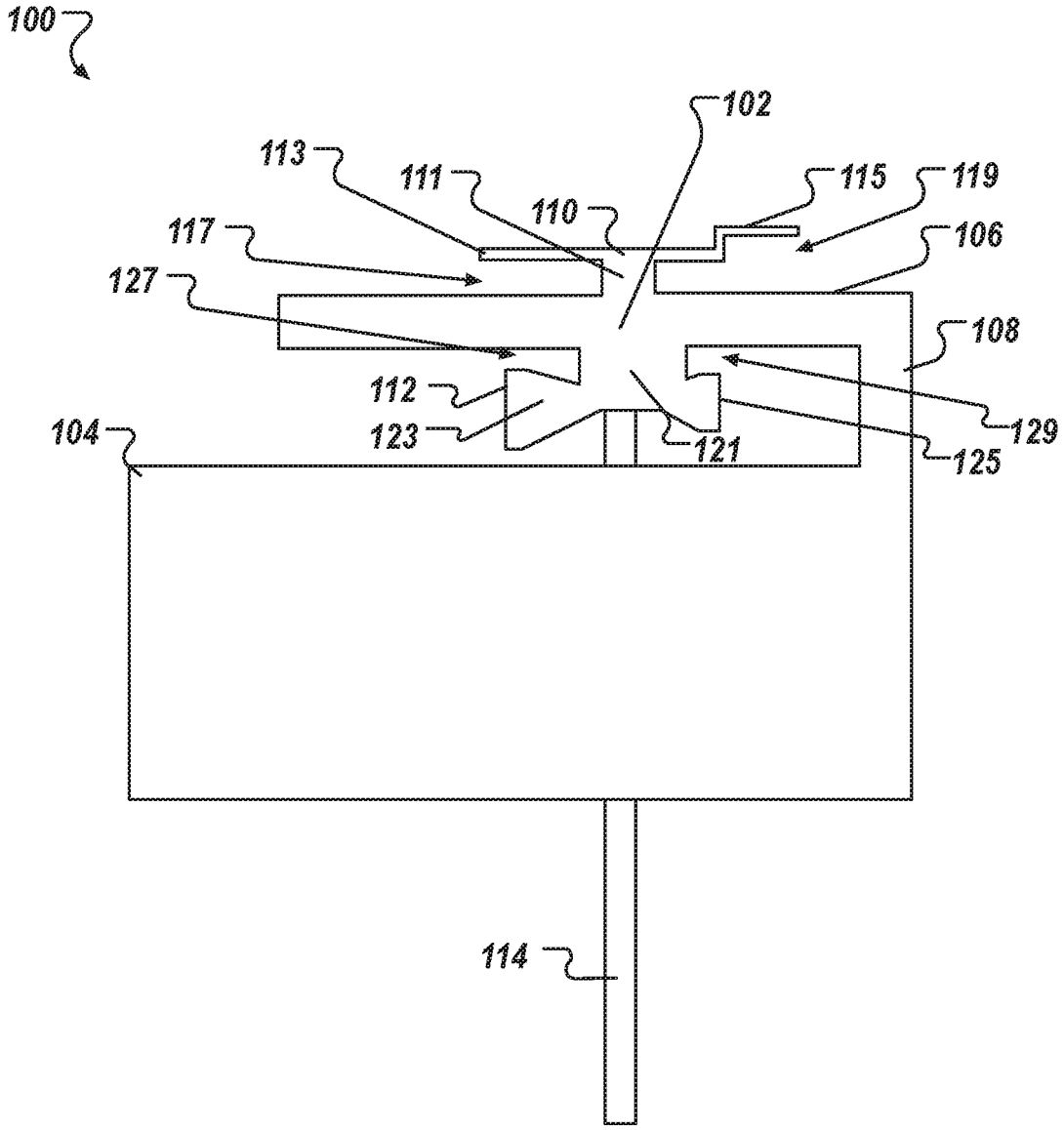
FIG. 1 illustrates one embodiment of a dual-band inverted-F antenna with a resonating T-shaped structure and a bowtie-shaped structure.

Antenna structures and methods of operating the same of a dual-band antenna of an electronic device are described. Some electronic devices have been built with one 2×2 Wi-Fi/BT chip, one ZigBee chip, two Wi-Fi antennas on a circuit board, one Flex BT antenna and one Flex ZigBee antenna. For example, the electronic device can be a voice control speaker device, including four speakers, one subwoofer, fifteen audio cables, and two large heatsinks. The volume of the electronic device is mostly metallic, which can be a challenging environment for the antennas to achieve good antenna performance especially antenna isolation. These devices can use multi-room music to play audio on multiple devices in a synchronized matter. To add video to multi-room media (MRM) use cases, the electronic device includes two Wi-Fi radios for supporting the normal use cases and the video MRM use cases. One 2×2 Wi-Fi dual-band radio can be used for an Access Point (AP) connection and a separate 2×2 or 1×1 single-band 5 GHz Wi-Fi radio can be used for low-latency audio distribution (Audio Video with Lip Sync (AVLS)). Two dual-band antennas can be used for 2×2 Wi-Fi communications with the AP, while one or two 5 GHz antennas can be used for low-latency audio distribution and one or two extra 5 GH Wi-Fi antennas are needed for video MRM. However, in an electronic device with limited space, there may not be additional space for one or two more antennas to be placed in the device. The additional separate antennas can also add to the cost of the device. It should also be noted that an absolute minimum of 45 dB isolation is required between the AP-Wi-Fi radio and Video-MRM Wi-Fi radio. This isolation can be obtained by using both the 5 GHz RF filters and a high isolation between AP-Wi-Fi and video-MRM Wi-Fi antennas. However, there is a limited isolation that could be obtained using filters because of limited space on the circuit board, and the cost and the size of a restricted area (also referred to as a "keep out" area) is needed for these filters. In addition, a shield for the filters can add to a height of the circuit board and has to be more than 5 mm, which affects the isolation between the different combination of radios, including Wi-Fi-BT, Wi-Fi-ZigBee, and Wi-Fi/AP-Wi-Fi/video MRM.

Aspects of the present disclosure address the above and other deficiencies by providing a dual-band antenna with an integrated structure that covers two frequency bands, such as the 2.45 GHz band and the 5 GHz band or the 900 MHz band and the 2.45 GHz band. For example, the dual-band antennas described herein can replace one or more both of the Flex BT antenna, the Flex ZigBee antenna, or any combination there. Accordingly, the BT antenna described above can be converted to a BT+5 GHz Wi-Fi antenna or the Zigbee antenna can be converted to a Zigbee+5 GHz Wi-Fi antenna. The antenna geometries can be uniquely shaped and placed to achieve the required inductance and capacitance by using slots (gaps) between them to achieve the dual resonances at 2.45 MHz and 5 GHz as described herein. The resonances are wide enough to cover full band at both 2.45 GHz and 5 GHz or the full bands at both 900 MHz and 2.4 GHz. In one embodiment, two bow-tie arms and two high impedance lines are located near the feed point. The antenna geometry can printed on a simple flex with single copper layer (no via holes) to achieve a low-cost alternative to achieve the additional functionality. The flexible circuit board can be coupled to a surface of a housing of the electronic device. Alternatively, the flexible circuit can be coupled to other structures within the housing, such as an antenna carrier, a support structure or the like. Alternatively, the radios, diplexers, and other antenna are disposed on a first circuit board and the dual-band antenna is disposed on a second circuit board (rigid or flexible). These unique antennas make possible implementation of video MRM hardware in an existing device without any changes and with no or minimal additional cost, such as a voice control speaker device described and illustrated with respect to FIGS. 2A-2B. In another embodiment, two resonating arms are uniquely shaped and placed to achieve the required inductance and capacitance by using slots (gaps) between them to achieve the dual resonances at 900 MHz and 2.45 GHz, as described herein. The resonances are wide enough to cover both US and EU bands for LoRa (Long Range) frequency bands and full Zigbee frequency bands. The antenna geometry can printed on a simple flex with single copper layer (no via holes) to achieve a low-cost alternative to achieve the additional functionality. Alternatively, antenna geometry can printed on a simple flex with single tin layer. The antenna geometry can be a low-cost simple flex with one-sided copper and no via holes or grounding lugs to keep the cost to a lower value. Alternatively, the antennas can be used in other types of devices.

Accordingly, aspects of the present disclosure can provide various advantages over the conventional antenna systems. For example, the aspects of the present disclosure can provide dual resonance without increasing cost, space, and complexity of design of the electronic device to facilitate additional functionality, such as video MRM. Aspects of the present disclosure can provide other advantages over the conventional systems.

FIG. 1 illustrates one embodiment of a dual-band inverted-F antenna 100 with a resonating T-shaped structure and a bowtie-shaped structure. The dual-band inverted-F antenna 100 includes a radio frequency (RF) feed 102 to which a single RF feed line 114 (e.g., coaxial) can be coupled. The dual-band inverted-F antenna 100 also includes a ground element 104, a resonating arm 106, and a shorting arm 108 that is coupled between the ground element 104 and the resonating arm 106 at a first side of the dual-band inverted-F antenna 100. The RF feed 102 is located at the resonating arm 106 at a point that is closer to the shorting arm 108 at a proximal end of the resonating arm 106 than an opening between a distal end of the resonating arm 106.

The dual-band inverted-F antenna 100 also includes a resonating T-shaped structure 110 coupled to a first side of the resonating arm 106 at the RF feed 102. The resonating T-shaped structure 110 includes a first base element 111 that extends out from the first side, a first arm 113 that extends in a first direction away from the first base element 111, and a second arm 115 that extends in a second direction away from the first base element 111. The first arm 113 forms a first gap 117 between the resonating T-shaped structure 110 and the ground element 104 and the second arm 115 forms a second gap 119 between the resonating arm 106 and the ground element 104.

The dual-band inverted-F antenna 100 also includes a bowtie-shaped structure 112 coupled to a second side of the resonating arm 106 at the RF feed 102. The bowtie-shaped structure 112 includes a second base element 121 that extends out from the second side, a first tapered element 123 that extends in the first direction away from the second base element 121, and a second tapered element 125 that extends in the second direction away from the second base element 121. The first tapered element 123 forms a third gap 127 between the bowtie-shaped structure 112 and the resonating arm 106 and the second tapered element 125 forms a fourth gap 129 between the bowtie-shaped structure 112 and the resonating arm 106.

In FIG. 1, the ground element 104 can be grounded to a ground potential of the single RF feed line 114. The RF feed 102 can include a feed line connector that connects to the single RF feed line 114 (also referred to as a RF cable or RF transmission line). The single RF feed line 114 can include a conductor that is coupled to the resonating arm 106 at the RF feed 102. The single RF feed line 114 can be grounded and coupled to the ground element 104. The single RF feed line 114 is a physical connection that carries RF signal to and/or from the dual-band inverted-F antenna 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the resonating arm 106 of the dual-band inverted-F antenna 100. A current is induced or applied at the RF feed 102, which causes current to flow along the various elements of the dual-band inverted-F antenna 100 according to RF signals to and from a radio coupled to the dual-band inverted-F antenna 100. The RF signals cause the dual-band inverted-F antenna 100 to radiate electromagnetic energy in one or both frequency bands as described herein in more detail with respect to FIGS. 2A-2B. The resonating T-shaped structure 110 and the bowtie-shaped structure 112 are located near the RF feed 102 (e.g., a feed point) and can be uniquely shaped and placed to achieve a required inductance and capacitance. Gaps 117, 119, 127, and 129 can be used to achieve dual resonances at 2.45 GHz and 5 GHz frequency bands. The resonances are wide enough to cover the 2.45 GHz frequency band and the 5 GHz frequency band. As described herein, the resonating T-shaped structure 110 and the bowtie-shaped structure 112 are physically connected to the resonating arm 106. When the resonating arm 106 is driven by RF signals from the radio, the physical connection between one element and another allows current to flow between the two antenna elements. In other contexts, for purposes of comparison, two elements can be coupled or form a "coupling," without being physically connected. For example, two antenna elements can be disposed in a way to form a capacitive coupling between the two antenna elements or an inductive coupling between the two antenna elements.

In one embodiment, the dual-band inverted-F antenna 100 is disposed on an antenna carrier (not illustrated), such as a dielectric carrier of the user device. The antenna carrier may be any non-conductive material, such as dielectric material, upon which the conductive material of the dual-band inverted-F antenna 100 can be disposed without making electrical contact with other metal of the user device. In another embodiment, the dual-band inverted-F antenna 100 is disposed on, within, or in connection with a circuit board, such as a printed circuit board (PCB) or a flexible circuit board. For example, the dual-band inverted-F antenna 100 can be printed copper (or tin) on a flexible circuit board. The dual-band inverted-F antenna 100 can be a single copper layer of the flexible circuit board. That is, the dual-band inverted-F antenna 100 does not use via holes between multiple layers. Alternatively, other conductive material can be used other than copper. In another embodiment, the dual-band inverted-F antenna 100 is printed on a circuit board and the circuit board is disposed within the electronic device. The various elements of the dual-band inverted-F antenna 100 can be one integrated component. Alternatively, the various elements of the dual-band inverted-F antenna 100 can be multiple components. In one embodiment, the ground element 104 can be a portion of a metal chassis of a circuit board. Alternatively, the dual-band inverted-F antenna 100 may be disposed on other components of the user device or within the user device. It should be noted that the dual-band inverted-F antenna 100 illustrated in FIG. 1 is a two-dimensional (2D) structure. However, as described herein, the dual-band inverted-F antenna 100 may include three-dimensional (3D) structures, as well as other variations than those depicted in FIG. 1.

In the depicted embodiment of FIG. 1, the first arm 113 is a conductive line and the second arm 115 includes a first section, a second section, and a third section, where the second section forms two folds between the first section and the third section. It should be noted that a "fold" refers to a bend, a corner, or other change in direction of the antenna element. For example, the fold may be where one segment of an antenna element changes direction in the same plane or in a different plane. Typically, folds in antennas can be used to fit the entire length of the antenna within a smaller area or smaller volume of a user device.

As illustrated, the first section extends in the second direction from the first base element 111 at a proximal end of the first section to a distal end of the first section. The second section extends in a third direction from the distal end of the first section at a proximal end of the second section to a distal end of the second section, the third direction being perpendicular to the second direction. The third section extends in the second direction from the distal end of the second section at a proximal end of the third section to a distal end of the third section. The proximal end of the first section corresponds to a proximal end of the second arm 115 and the distal end of the third section corresponds to a distal end of the second arm 115. Alternatively, the second arm can include different types of sections and different number of sections.

In the depicted embodiment of FIG. 1, the first tapered element 123 has a proximal end and a distal end, where a first height of the first tapered element at the distal end of the first tapered element 123 is greater than a second height of the first tapered element 123 at the proximal end of the first tapered element 123 near the RF feed 102. The second tapered element 125 has a proximal end and a distal end, where a first height of the second tapered element 125 at the distal end of the second tapered element 125 is greater than a second height of the second tapered element 125 at the proximal end of the second tapered element 125. In the depicted embodiment, the first height of the first tapered element 123 is greater than the first height of the second tapered element 125. In other embodiments, the heights and dimensions are the same. Alternatively, the dimensions of the two tapered elements can vary from one another to achieve a specified inductance for the dual-band inverted-F antenna 100. Similarly, the dimensions of the first arm 113 and the second arm 115 can be similar or dissimilar. As illustrated, the first base element 111 has a first width and the second base element 121 has a second width that is greater than the first width. Alternatively, the widths of the first base element 111 and the second base element 121 can be the same or the first base element 111 can be wider than the second base element 121.

The dimensions of the dual-band inverted-F antenna 100 may be varied to achieve the desired frequency range; however, the total length of the antennas is a major factor for determining the frequency, and the width of the antennas is a factor for impedance matching. It should be noted that the factors of total length and width are dependent on one another. The dual-band inverted-F antenna 100 may have various dimensions based on the various design factors. In one embodiment, the dual-band inverted-F antenna 100 has an overall height (h), an overall width (w), and an overall depth (d). The overall height (h) may vary, but, in one embodiment, is about 25 mm. The overall width (w) may vary, but, in one embodiment, is about 35 mm. The overall depth may vary, but, in one embodiment, is about 0.1 to 3 mm or less. It should also be noted that other shapes for the dual-band inverted-F antenna 100 are possible. For example, the first arm 113 and the second arm 115 can have various bends, such as to accommodate placement of other components, such as a speakers, microphones, USB ports. In one embodiment, the first arm 113 includes a first length (or width) of about 5.5 mm, the second arm 115 includes a second length (or width) of about 7.5 mm, the first tapered element 123 include a third length (or width) of about 5.2 mm, and the second tapered element 125 includes a fourth length (or width) of about 3.6 mm. Collectively, the bowtie-shaped structure has a total length (or width) of about 8.8 mm. Alternatively, other dimensions can be used for the first arm 113, the second arm 115, the first tapered element 123 and the second tapered element 125.

During operation, a radio coupled to the single RF feed line 114 applies RF signals to the dual-band inverted-F antenna 100, which cause the dual-band inverted-F antenna 100 to radiate electromagnetic energy in at least two resonances, such as 2.45 GHz frequency band (e.g., PAN communications or WLAN communications) and 5 GHz frequency band (e.g., WLAN communications). For example, a dual-band WLAN radio communicates data with a second WLAN radio of a second device by radiating electromagnetic energy at the 5 GHz frequency band via the dual-band inverted-F antenna 100 and communicates data with a second WLAN radio of a third device by radiating electromagnetic energy at the 2.45 GHz frequency band via the dual-band inverted-F antenna 100. Alternatively, two radios can be coupled to the single RF feed line 114 via a diplexer. For example, a WLAN radio communicates data with a second WLAN radio of a second device by radiating electromagnetic energy at the 5 GHz frequency band via the dual-band inverted-F antenna 100 and a PAN radio communicates data with a second PAN radio of a third device by radiating electromagnetic energy at the 2.45 GHz frequency band via the dual-band inverted-F antenna 100.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, television, set-top boxes, dongles, and the like. The user device may connect to a network to obtain content from a server computing system (e.g., an item providing system) or to perform other activities. The user device may connect to one or more different types of cellular networks.

The embodiments described herein increase the capabilities of the antenna to cover additional resonant modes. In one embodiment, the dual-band antenna includes a resonating arm that operates as a feeding structure to other elements disposed near the RF feed. The dual-band antenna has a single RF feed that drives the resonating arm of an inverted-F antenna as an active or driven element. By coupling the driven element and the other elements described herein, additional resonant modes can be created or existing resonant modes can be improved, such as decreasing the reflection coefficient or extending the bandwidth. The dual-band inverted-F antenna 100 can be used to change the resonance frequencies of an electronic device, such as to cover two different high bands. The different radios or different modes of a radio can be used to control the current flow to induce different antenna modes, such as to cover a first frequency range of about 2.4 GHz to about 2.5 GHz in a first resonant mode and to cover a second frequency range of about 4.9 GHz to about 5.9 GHz in a second resonant mode. Alternatively, the first frequency range can be about 800 MHz to about 1000 MHz in a first resonant mode and to cover a second frequency range of about 2.4 GHz to about 2.5 GHz in a second resonant mode.

The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes, for example, a first high-band mode and a second high-band mode. References to operating in one or more resonant modes indicates that the characteristics of the antenna structure, such as length, position, width, proximity to other elements, ground, or the like, decrease a reflection coefficient at certain frequencies to create the one or more resonant modes. Also, some of these characteristics can be modified to tune the frequency response at those resonant modes, such as to extend the bandwidth, increase the return loss, decrease the reflection coefficient, or the like. The embodiments described herein provide a dual-band antenna to be coupled to a single RF feed and does not use any active tuning to achieve the extended bandwidths. The embodiments described herein also provide a dual-band antenna with increased bandwidth in a size that is conducive to being used in a user device, including devices with surrounding metallic components.

Figure 2B:
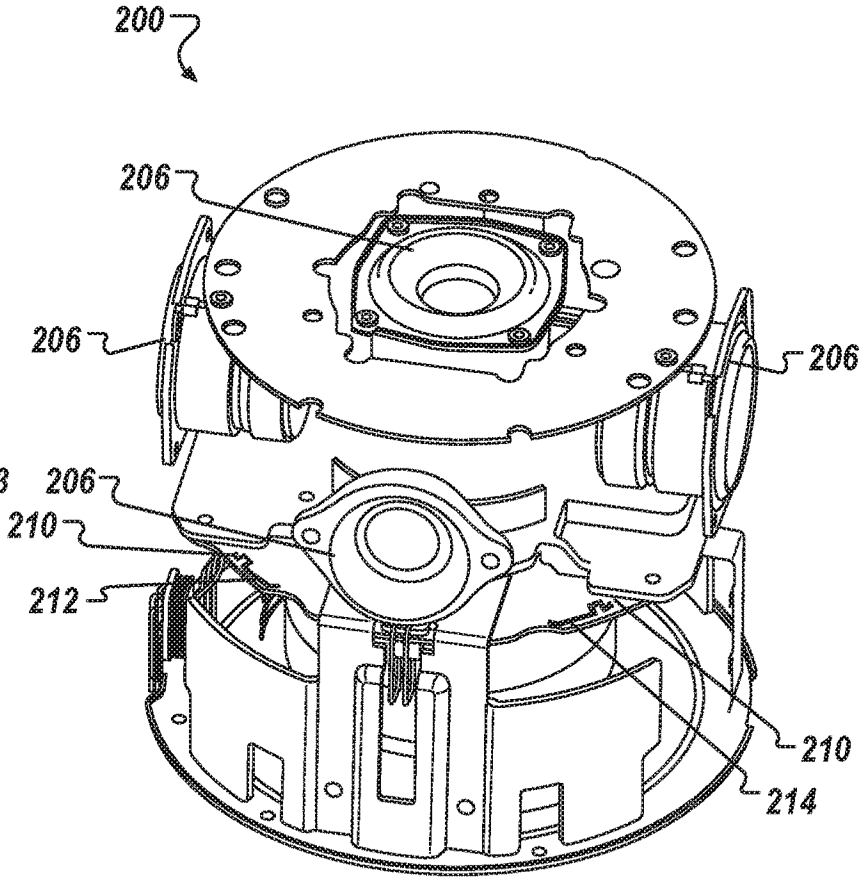
FIGS. 2A-2B illustrate one embodiment of an electronic device with two dual-band inverted-F antennas of FIG. 1.
Figure 2A:
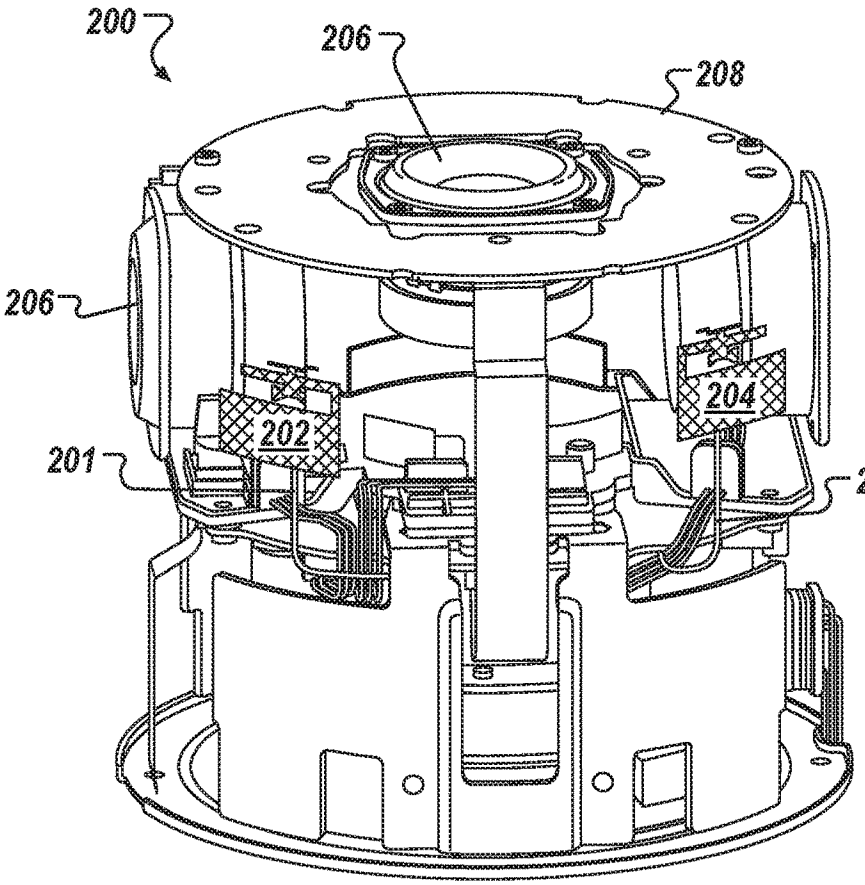

FIGS. 2A-2B illustrate one embodiment of an electronic device 200 with two dual-band inverted-F antennas of FIG. 1. FIG. 2A is a first perspective view of the electronic device 200 and FIG. 2B is a second perspective view of the electronic device 200. The electronic device 200 includes multiple speakers 206, including a subwoofer at the bottom of the electronic device 200. The electronic device 200 includes a first circuit board 208 upon which one or more microphones are disposed. The first circuit board 208 is disposed at a top side of the electronic device 200, whereas the subwoofer is disposed at a bottom side of the electronic device 200. The electronic device 200 also includes a second circuit board 210 (see FIG. 2B). Multiple radios, including a first 2×2 WLAN radio, a second 2×2 WLAN radio, a diplexer, and a PAN radio are disposed on the second circuit board 210. A first WLAN antenna 212 and a second WLAN antenna 214 are coupled to the first 2×2 WLAN radio. The diplexer is coupled to the second 2×2 WLAN radio and the PAN radio. As illustrated in FIG. 2A, the electronic device 200 includes two dual-band inverted-F antennas 202 and 204. The dual-band inverted-F antennas 202 and 204 can each correspond to the dual-band inverted-F antenna 100 of FIG. 1. A first dual-band inverted-F antenna 202 is coupled to the diplexer via a single coaxial RF feed line 201, which is coupled to the second 2×2 WLAN radio and the PAN radio. A second dual-band inverted-F antenna 204 is coupled to the diplexer via a single coaxial RF feedline 203, which is coupled to the second 2×2 WLAN radio and the PAN radio. In other embodiments, other numbers of radios and diplexers can be used.

As described above with respect to the dual-band inverted-F antenna 100 of FIG. 1, the first dual-band inverted-F antenna 202 has an RF feed that is coupled to the diplexer via a RF cable (e.g., a coaxial cable). The first dual-band inverted-F antenna 202 includes a ground element, a first arm; a shorting arm coupled between the ground element and the first arm at a first side of the first dual-band inverted-F antenna 202. The dual-band inverted-F antenna 202 also includes a dual-arm structure (e.g., two conductive arms) coupled to a first side of the first arm at the RF feed. The dual-arm structure can include a first base element that extends out from the first side, a first arm that extends in a first direction away from the first base element, and a second arm that extends in a second direction away from the first base element. The first arm forms a first gap between the dual-arm structure and the ground element and the second arm forms a second gap between the dual-arm structure and the ground element. The first dual-band inverted-F antenna 202 also includes a dual-element structure (e.g., bowtie-shaped structure with two tapered elements) coupled to a second side of the first arm at the RF feed. The dual-element structure can include a second base element that extends out from the second side, a first tapered element that extends in the first direction away from the second base element, and a second tapered element that extends in the second direction away from the second base element.

As illustrated in FIGS. 2A-2B, the electronic device 200 includes various components of metal, which can produce a challenging environment for antennas to achieve good antenna performance. In one embodiment, the electronic device 200 can provide Wi-Fi® access (or other access point connection) via the first WLAN antenna 212 and the second WLAN antenna 214 that are disposed on the second circuit board 210 and the two dual-band inverted-F antennas 202 and 204 can be used to expand the electronic device's capabilities to include video MRM use cases. In one embodiment, to add video MRM use cases, the electronic device 200 includes two Wi-Fi radios for supporting the normal use cases and the video MRM use cases. One 2×2 Wi-Fi dual-band radio can be used for an AP connection and a separate 2×2 or 1×1 single-band 5 GHz Wi-Fi radio can be used for low-latency audio distribution (e.g., AVLS)). The two WLAN antennas 212 and 214 can be used for 2×2 Wi-Fi communications with the AP, while at least one of the two dual-band inverted-F antennas 202 and 204 (e.g., 5 GHz Wi-Fi antennas) can be used for low-latency audio distribution and video MRM. As described above, space is limited in the electronic device 200 to provide placement of additional antennas. The two dual-band inverted-F antennas 202 and 204 can occupy a similar space to a single-band PAN antenna (e.g., BT antenna or Zigbee antenna). It should also be noted that an absolute minimum of 45 dB isolation is achieved by the AP Wi-Fi radio and the Video MRM Wi-Fi radio. This isolation can be obtained without using 5 GHz RF filters, rather high isolation between AP-Wi-Fi and video-MRM Wi-Fi antennas can be obtained by the design of the two dual-band inverted-F antennas 202 and 204. Since no filters are used, a shield for the filters is also not needed. The two dual-band inverted-F antennas 202 and 204 cover two frequency bands, such as the 2.45 GHz band and the 5 GHz band. For example, the dual-band antennas described herein can replace one or more both of the Flex BT antenna, the Flex ZigBee antenna, or any combination there. Accordingly, the BT antenna described above can be converted to a BT+5 GHz Wi-Fi antenna or the Zigbee antenna can be converted to a Zigbee+5 GHz Wi-Fi antenna. The antenna geometries can be uniquely shaped and placed to achieve the required inductance and capacitance by using slots (gaps) between them to achieve the dual resonances at 2.45 MHz and 5 GHz as described herein. The resonances are wide enough to cover full band at both 2.45 GHz and 5 GHz. In one embodiment, two bow-tie arms and two high impedance lines are located near the feed point, such as illustrated in FIG. 2A. The antenna geometry can printed on a simple flex with single copper layer (no via holes) to achieve a low-cost alternative to achieve the additional functionality.

In one embodiment, the first dual-band inverted-F antenna 202 and the second dual-band inverted-F antenna 204 are printed on flexible circuit boards, respectively. In another embodiment, the first dual-band inverted-F antenna 202, the second dual-band inverted-F antenna 204, or both can be disposed on a single layer of a flexible circuit board. Alternatively, the first dual-band inverted-F antenna 202, the second dual-band inverted-F antenna 204, or both can be disposed on a rigid circuit board. The first dual-band inverted-F antenna 202 and the second dual-band inverted-F antenna 204 can be disposed on a single layer or on multiple layers. In one embodiment, the first dual-band inverted-F antenna 202 and the second dual-band inverted-F antenna 204 are made of copper. Alternatively, other conductive materials can be used.

In one embodiment, a WLAN radio communicates first data with a second WLAN radio of a second device by radiating electromagnetic energy at the 5 GHz frequency band via the dual-band inverted-F antenna 202 and the PAN radio communicates second data with a second PAN radio of a third device by radiating electromagnetic energy at the 2.45 GHz frequency band via the same dual-band inverted-F antenna 202. The first data can be video data and the second data can be audio data. A second WLAN radio communicates third data with the second WLAN radio or a fourth WLAN radio of a fourth device by radiating electromagnetic energy at the 5 GHz frequency band via the dual-band inverted-F antenna 204 and the PAN radio communicates fourth data with a second PAN radio of a third device by radiating electromagnetic energy at the 2.45 GHz frequency band via the same dual-band inverted-F antenna 204. The third data can be video data and the fourth data can be audio data. Alternatively, the different radios can communicate audio, video, or any combination thereof.

In one embodiment, the PAN radio communicates data with the second PAN radio using at least one of the Zigbee® protocol according to the IEEE 802.15.4 specification or the Bluetooth® protocol. That is, in one embodiment, the PAN radio communicates the second data with the fourth radio using the Zigbee® technology and the WLAN radio communicates the first data with the third radio using the Wi-Fi® technology. In another embodiment, the PAN radio communicates the second data with the fourth radio using the Bluetooth® technology and the WLAN radio communicates the first data with the third radio using the Wi-Fi® technology. Alternatively, other protocols can be used.

In this embodiment, the dual-band inverted-F antennas 202 and 204 are coplanar 2D structures as illustrated in the top perspective view of FIG. 2A. The 2D structures can wrap around different sides of the antenna carrier, an inner surface of a cover of the electronic device 200, or the like. In particular, in the depicted embodiment, the various elements of the dual-band inverted-F antennas 202 and 204 are disposed in a first plane (e.g., a back surface of a cover (not illustrated in FIGS. 2A-2B) of the electronic device 200. In other embodiments, some portions of the dual-band inverted-F antennas 202 and 204 can be disposed in one or more additional planes. Also, as described above, these elements of the dual-band inverted-F antenna can be disposed to be coplanar as a 2D structure, but the 2D structure is bent or curved to correspond with a surface upon which dual-band inverted-F antenna is disposed.

Strong resonances are not easily achieved within a compact space within user devices, especially within the spaces on consumer devices. The structure of the dual-band inverted-F antenna 100 provides strong resonances at a first frequency range of about 2.4 GHz to 2.7 GHz in the first mode and at a second frequency range of about 4.9 GHz to 5.9 GHz in the second mode. These can be both considered high-band modes, but the antenna structure can be designed to operate in low-band modes as described herein. Strong resonances, as used herein, refer to a significant return loss at those frequency bands, which is better for impedance matching to 50-ohm systems. These multiple strong resonances can provide an improved antenna design as compared to conventional designs. It should be noted that for 1×1 Video-MRM Wi-Fi, only one of the dual-band inverted-F antennas (e.g., flex antennas) needs to be dual-band. Alternatively, both dual-band inverted-F antennas can be dual-band.

Figure 3:
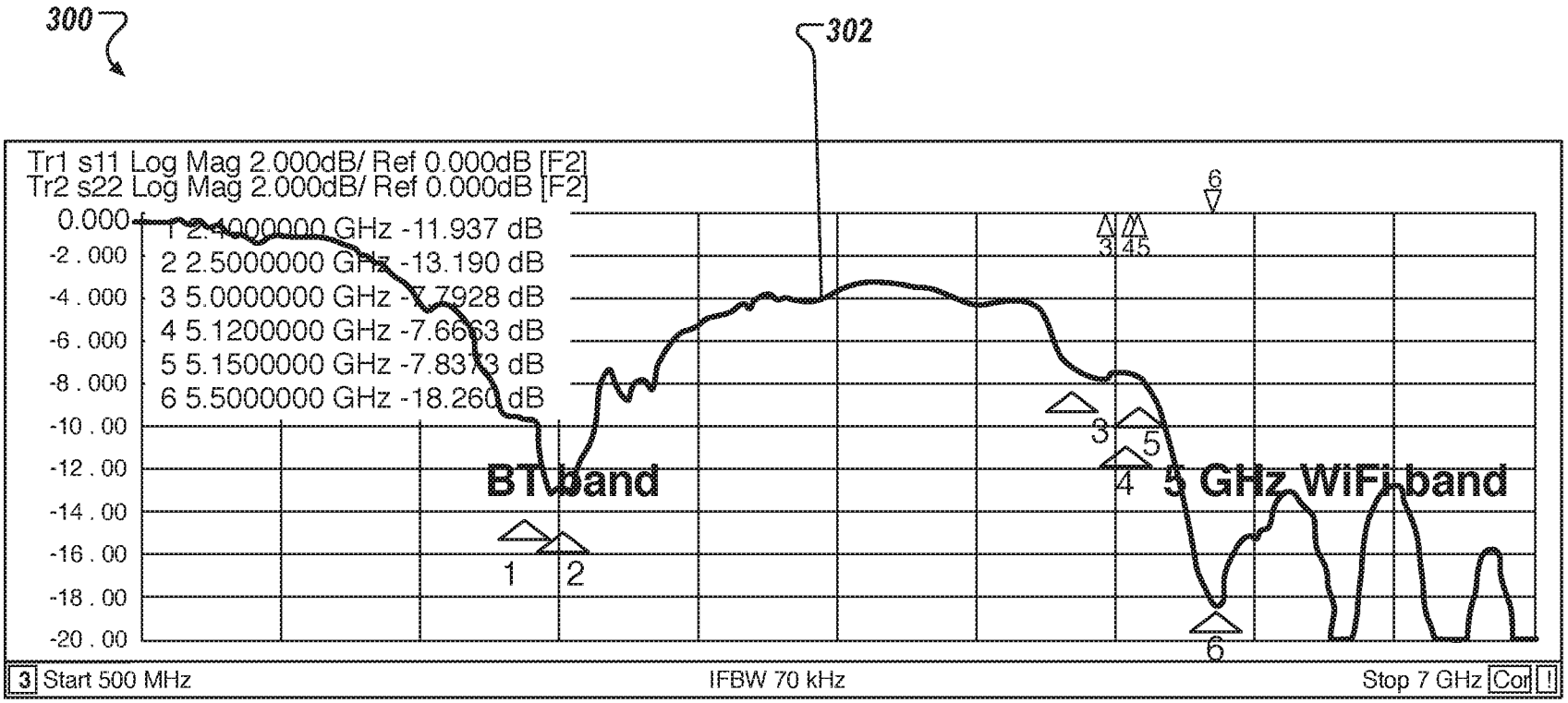
FIG. 3 is a graph of measured return loss of the dual-band inverted-F antenna of FIG. 1 according to one embodiment.

FIG. 3 is a graph 300 of measured return loss of the dual-band inverted-F antenna of FIG. 1 according to one embodiment. The graph 300 shows the measured return loss 302 of the dual-band inverted-F antenna of FIG. 1 to operate as a PAN antenna in a first resonant mode and as a WLAN antenna in a second resonant mode. Corresponding radios coupled to the dual-band inverted-F antenna 100 of FIG. 1 can operate simultaneously or concurrently given the isolation between the two resonant modes. More specifically, the dual-band inverted-F antenna 100 provides a resonant mode of those respective frequencies in the different modes of operation. That is, the dual-band inverted-F antenna 100 decreases the return loss at the corresponding frequencies to create or form a first resonance that sufficiently covers the 2.4 GHz to 2.5 GHz frequency range and a second resonance that sufficiently covers the 5 GHz to 5.5 GHz frequency range. As described herein, other resonant modes may be achieved. Also, other frequency ranges may be covered by different designs of the dual-band antenna. It should be noted that the terms "first," "second," "third," "fourth," etc. as used herein are meant as labels to distinguish among different elements and may not necessarily have an ordinal meaning according to their numerical designation.

Figure 4:
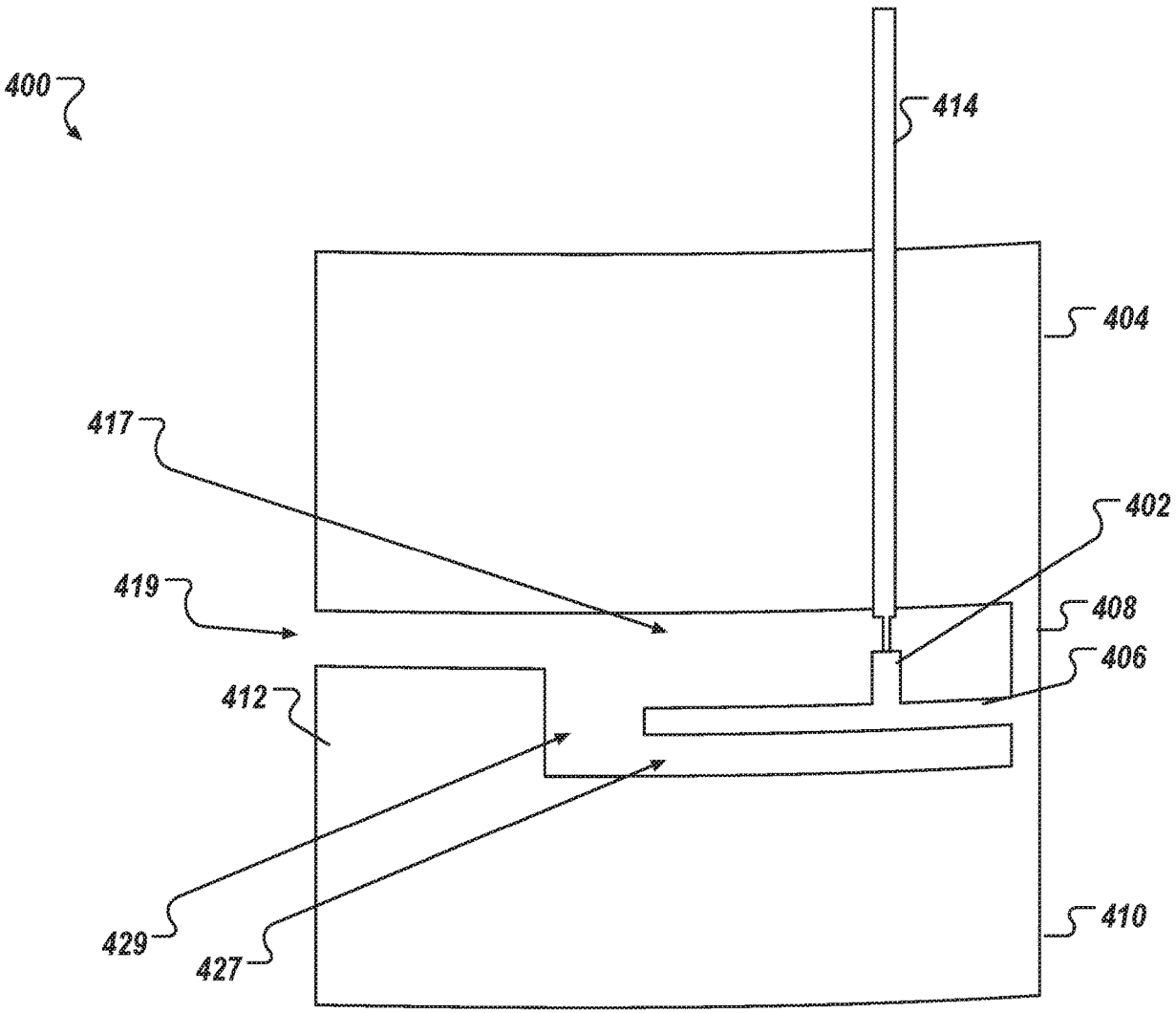
FIG. 4 illustrates another embodiment of a dual-band inverted-F antenna with a resonating arm and a second folded arm.

FIG. 4 illustrates another embodiment of a dual-band inverted-F antenna 400 with two resonating arms. The dual-band inverted-F antenna 400 includes a RF feed 402 to which a single coaxial RF feed line 414 can be coupled. The dual-band inverted-F antenna 400 also includes a ground element 404, a first resonating arm 406, a shorting arm 408 that is coupled between the ground element 404 and the first resonating arm 406 at a first side of the dual-band inverted-F antenna 400, and a second resonating arm 410. The RF feed 402 is located at the first resonating arm 406 at a point that is closer to the shorting arm 408 at a proximal end of the first resonating arm 406 than an opening between a distal end of the first resonating arm 406.

In addition to the first resonating arm 406, the dual-band inverted-F antenna 400 also includes the second resonating arm 410 with a folded portion 412, forming a folded arm structure. The second resonating arm 410 is disposed on an opposite side of the first resonating arm 406 than the ground element 404. The second resonating arm 410 is coupled to the shorting arm 408 that extends away from the ground element 404 in a first direction. The first resonating arm 406 and the second resonating arm 410 are coupled to the shorting arm 408. The second resonating arm 410 extends in a second direction away from a first side of the dual-band inverted-F antenna 400 towards a second side of the dual-band inverted-F antenna 400, the first side corresponding to a side where the shorting arm 408 is located. Near the second side of the dual-band inverted-F antenna 400, the folded portion 412 extends in a third direction towards the ground element 404 from the second resonating arm 410. The second direction can be perpendicular to the first direction and the third direction. The first resonating arm 406 forms a first gap 417 between the first resonating arm 406 and the ground element 404. The second resonating arm 410 forms a second gap 419 between the second resonating arm 410 and the ground element 404, a third gap 427 between the first resonating arm 406 and the second resonating arm 410 in the first direction, and a fourth gap 429 between the first resonating arm 406 and the second resonating arm 410 in the second direction.

In FIG. 4, the ground element 404 can be grounded to a ground potential of the single RF feed line 414. The RF feed 402 can include a feed line connector that connects to the single RF feed line 414 (also referred to as a RF cable or RF transmission line). The single RF feed line 414 can include a conductor that is coupled to the first resonating arm 406 at the RF feed 402. The single RF feed line 414 can be grounded and coupled to the ground element 404. The single RF feed line 414 is a physical connection that carries RF signal to and/or from the dual-band inverted-F antenna 400. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the first resonating arm 406 of the dual-band inverted-F antenna 400. A current is induced or applied at the RF feed 402, which causes current to flow along the various elements of the dual-band inverted-F antenna 400 according to RF signals to and from a radio coupled to the dual-band inverted-F antenna 400. The RF signals cause the dual-band inverted-F antenna 400 to radiate electromagnetic energy in one or both frequency bands as described herein in more detail with respect to FIG. 5. The first resonating arm 406 and the second resonating arm 410 can be uniquely shaped and placed to achieve a required inductance and capacitance. Gaps 417, 419, 427, and 429 can be used to achieve dual resonances at 900 MHz (or other sub-GHz) and 2.45 GHz frequency bands. The resonances are wide enough to cover LoRa frequency band and 2.45 GHz frequency band. As described herein, the first resonating arm 406 and the second resonating arm 410 are physically connected to the shorting arm 408. When the first resonating arm 406 is driven by RF signals from the radio, the physical connection between one element and another allows current to flow between the two antenna elements. In other contexts, for purposes of comparison, two elements can be coupled or form a "coupling," without being physically connected. For example, two antenna elements can be disposed in a way to form a capacitive coupling between the two antenna elements or an inductive coupling between the two antenna elements.

In one embodiment, the dual-band inverted-F antenna 400 is disposed on an antenna carrier (not illustrated), such as a dielectric carrier of the user device. The antenna carrier may be any non-conductive material, such as dielectric material, upon which the conductive material of the dual-band inverted-F antenna 400 can be disposed without making electrical contact with other metal of the user device. In another embodiment, the dual-band inverted-F antenna 400 is disposed on, within, or in connection with a circuit board, such as a printed circuit board (PCB) or a flexible circuit board. For example, the dual-band inverted-F antenna 400 can be printed copper on a flexible circuit board. The dual-band inverted-F antenna 400 can be a single copper layer of the flexible circuit board. That is, the dual-band inverted-F antenna 400 does not use via holes between multiple layers. Alternatively, other conductive material can be used other than copper. In another embodiment, the dual-band inverted-F antenna 400 is printed on a circuit board and the circuit board is disposed within the electronic device. The various elements of the dual-band inverted-F antenna 400 can be one integrated component. Alternatively, the various elements of the dual-band inverted-F antenna 400 can be multiple components. In one embodiment, the ground element 404 can be a portion of a metal chassis of a circuit board. Alternatively, the dual-band inverted-F antenna 400 may be disposed on other components of the user device or within the user device. It should be noted that the dual-band inverted-F antenna 400 illustrated in FIG. 4 is a 2D structure. However, as described herein, the dual-band inverted-F antenna 400 may include 3D structures, as well as other variations than those depicted in FIG. 4.

The dimensions of the dual-band inverted-F antenna 400 may be varied to achieve the desired frequency range; however, the total length of the antennas is a major factor for determining the frequency, and the width of the antennas is a factor for impedance matching. It should be noted that the factors of total length and width are dependent on one another. The dual-band inverted-F antenna 400 may have various dimensions based on the various design factors. In one embodiment, the dual-band inverted-F antenna 400 has an overall height (h), an overall width (w), and an overall depth (d). The overall height (h) may vary, but, in one embodiment, is about 45 mm. The overall width (w) may vary, but, in one embodiment, is about 45 mm. The overall depth may vary, but, in one embodiment, is about 0.1 to 3.0 mm or less. It should also be noted that other shapes for the dual-band inverted-F antenna 400 are possible. For example, the first resonating arm 406 and the second resonating arm 410 can have various bends, such as to accommodate placement of other components, such as a speakers, microphones, USB ports. In one embodiment, the first resonating arm 406 includes a first length (or width) of about 22 mm and the second resonating arm 410 includes a second length (or width) of about 45 mm. The first gap 417 can have a first height of about 6 mm, the second gap 419 can have a second height of about 3.4 mm, the third gap 427 can have a third height of about 2.5 mm, and the fourth gap can have a width of about 6.2 mm. The dual-band inverted-F antenna 400 can include a gap between the ground element 404 and the second resonating arm 410 closer to the RF feed 402. This can have a height of about 10 mm. Alternatively, other dimensions can be used for the first resonating arm 406, the second resonating arm 410 (include the folded portion 412), and the corresponding gaps.

During operation, a radio coupled to the single RF feed line 414 applies RF signals to the dual-band inverted-F antenna 400, which cause the dual-band inverted-F antenna 400 to radiate electromagnetic energy in at least two resonances, such as 900 MHz frequency band (860-930 MHz) and the 2.45 GHz frequency band (e.g., PAN communications or WLAN communications). For example, a PAN radio communicates first data with a second PAN radio of a second device by radiating electromagnetic energy at the 2.45 GHz frequency band via the dual-band inverted-F antenna 400 and a LoRa radio communicates second data with a second LoRa radio of a third device by radiating electromagnetic energy at the 800-1000 MHz frequency band via the dual-band inverted-F antenna 400. The PAN radio and the LoRa radio can be coupled to the single RF feed line 414 via a diplexer.

Figure 5:
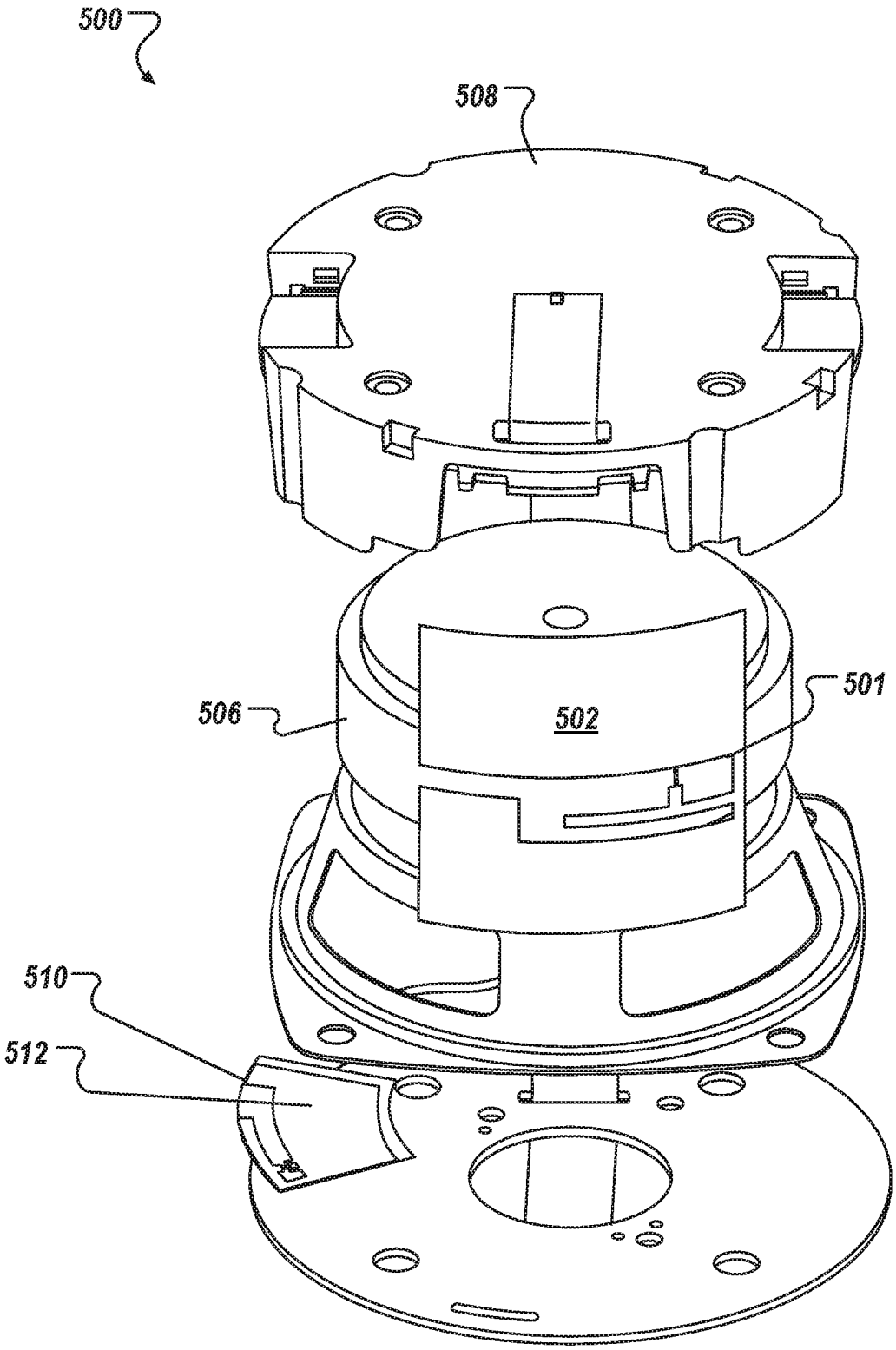
FIG. 5 illustrates one embodiment of an electronic device with the dual-band inverted-F antenna of FIG. 4.

FIG. 5 illustrates one embodiment of an electronic device 500 with a dual-band inverted-F antenna 502. The dual-band inverted-F antenna 502 can correspond to the dual-band inverted-F antenna 400 of FIG. 4. FIG. 5 is a first perspective view of the electronic device 500. The electronic device 500 includes a speaker 506. The electronic device 500 includes a first circuit board 508 upon which one or more microphones are disposed. The first circuit board 508 is disposed at a top side of the electronic device 500, whereas the speaker 506 is disposed facing a bottom side of the electronic device 500. The electronic device 500 also includes a second circuit board 510 upon which a WLAN antenna 512 is disposed. Multiple radios, including a WLAN radio, a diplexer, a PAN radio, and a LoRa radio are disposed on the second circuit board 510. It should be noted that the WLAN antenna 512 and the second circuit board 510 are shown as being elevated from a portion of the electronic device 500 in which these components are disposed for illustration purposes only.

The WLAN antenna 512 can be coupled to the WLAN radio. The dual-band inverted-F antenna 502 is coupled to a diplexer via a single coaxial RF feed line 501, which is coupled to the PAN radio and the LoRa radio. In other embodiments, other numbers of radios, diplexers, and antennas can be used.

As described above with respect to the dual-band inverted-F antenna 400 of FIG. 4, the dual-band inverted-F antenna 502 has an RF feed that is coupled to the diplexer via a RF cable (e.g., a coaxial cable). The dual-band inverted-F antenna 502 includes a ground element, a first resonating arm; a shorting arm coupled between the ground element and the first arm at a first side of the first dual-band inverted-F antenna 502. The dual-band inverted-F antenna 502 also includes a second resonating arm coupled to a first side of the first arm at the RF feed. The second resonating arm 410 is disposed on an opposite side of the first resonating arm 406 than the ground element 404. The first resonating arm 406 forms a first gap 417 between the first resonating arm 406 and the ground element 404. The second resonating arm 410 forms a second gap 419 between the second resonating arm 410 and the ground element 404, a third gap 427 between the first resonating arm 406 and the second resonating arm 410 in the first direction, and a fourth gap 429 between the first resonating arm 406 and the second resonating arm 410 in the second direction.

As illustrated in FIG. 5, the electronic device 500 includes various components of metal, which can produce a challenging environment for antennas to achieve good antenna performance. In one embodiment, the electronic device 500 can provide Wi-Fi® access (or other access point connection) via the WLAN antenna 512 that is disposed on the second circuit board 510 and the dual-band inverted-F antennas 502 can be used to expand the electronic device's capabilities to include both PAN communication and LoRa communications. In one embodiment, the electronic device 500 includes a Wi-Fi radio for supporting the normal use cases. The Wi-Fi radio can be a Wi-Fi dual-band radio and can be used for an AP connection. The WLAN antenna 512 can be used for Wi-Fi communications with the AP, while the dual-band inverted-F antennas 502 (e.g., 2.4 GHz PAN and 800-1000 MHz) can be used for other communications. As described above, space is limited in the electronic device 500 to provide placement of additional antennas. The dual-band inverted-F antenna 502 can occupy a similar space to a single-band PAN antenna (e.g., Zigbee antenna). The dual-band inverted-F antenna 502 covers two frequency bands, such as the 800-1000 MHz band and the 2.45 GHz band. For example, the dual-band antenna described herein can replace a Flex Zigbee antenna, a BT antenna, or any combination there. Accordingly, the Zigbee antenna described above can be converted to a 2.4 GHz Zigbee antenna+800-1000 MHz LoRa antenna. The antenna geometries can be uniquely shaped and placed to achieve the required inductance and capacitance by using slots (gaps) between them to achieve the dual resonances at 800-1000 MHz and 2.45 MHz as described herein. The resonances are wide enough to cover full band at both 800-1000 MHz and 2.45 GHz. The antenna geometry can printed on a simple flex with single copper layer (no via holes) to achieve a low-cost alternative to achieve the additional functionality.

In one embodiment, the dual-band inverted-F antenna 502 is printed on a flexible circuit board. In another embodiment, the dual-band inverted-F antenna 502 can be disposed on a single layer of a flexible circuit board. Alternatively, the dual-band inverted-F antenna 502 can be disposed on a rigid circuit board. The dual-band inverted-F antenna 502 can be disposed on a single layer or on multiple layers. In one embodiment, the dual-band inverted-F antenna 502 is made of copper. Alternatively, other conductive materials can be used.

In one implementation, the electronic device supports dual-band 2×2 Wi-Fi/BLE and a built-in smart home hub using a Zigbee radio. The electronic device has four separate antennas to support these three communication systems (Wi-Fi, BT, and Zigbee). The size of the electronic device can be much smaller (149 mm×100 mm×100 mm) when compared to another electronic device (235 mm×84 mm×84 mm), but provides a similar wireless performance. Despite the lower volume, the larger audio subwoofer and tweeter parts and large thermal heatsink, which are all metallic parts, occupy most of the device volume, which can provide a challenging environment for antennas. Another electronic device includes the same three communication systems (Wi-Fi, BT, and Zigbee), as well as a LoRa radio (as illustrated in FIG. 5). In order to implement sub-GHz (800-1000 MHz) radio in the electronic device 500 with the lowest possible cost and no dramatic changes, the dual-band inverted-F antenna 502 can be used to achieve this additional functionality without any significant structural changes to the electronic device 500. The sub-GHz radio can permit the electronic device to be an Internet of Thing (JOT) device that can enable home automation, such as smart home lighting. Instead of adding an extra antenna, the sub-GHz antenna can be integrated with the Zigbee antenna as described herein. The LoRa radio can use the dual-band inverted-F antenna 502 to cover 860-930 MHz without adding additional space for the respective antenna, especially considering the lower relative frequency results in a comparatively larger antenna than the Zigbee or Bluetooth antennas. Furthermore, a new separate antenna can degrade the antenna isolations needed for Wi-Fi-Zigbee coexistence. The dual-band inverted-F antenna 502 is a dual-band antenna which can cover both Zigbee (2.45 GHz) as well as LoRa frequency bands (860-930 MHz). The dual-band inverted-F antenna 502 can be a simple, low-cost flex with one-sided copper and no via holes or grounding lugs to keep the cost of the dual-band inverted-F antenna 502 as low as possible. The antenna geometries of the dual-band inverted-F antenna 502 include resonating element arms that are uniquely shaped and placed to achieve the specified inductance and capacitance by using the slots (gaps) between them to achieve the dual resonance at 900 MHz and 2.45 GHz. As described herein, the resonance is wide enough to cover both US and EU bands for LoRa and full Zigbee frequency bands.

In one embodiment, a WLAN radio communicates first data with a second WLAN radio of a second device by radiating electromagnetic energy at the 5 GHz (or 2.45 GHz) frequency band via the WLAN antenna 512. The PAN radio communicates second data with a second PAN radio of a third device by radiating electromagnetic energy at 2.45 GHz frequency band via the dual-band inverted-F antenna 502 and the LoRa radio communicates third data with a second LoRa radio of a fourth device by radiating electromagnetic energy at the 800-1000 MHz frequency band via the same dual-band inverted-F antenna 202.

In one embodiment, the PAN radio communicates the second data with the second PAN radio using at least one of the Zigbee® protocol according to the IEEE 802.15.4 specification or the Bluetooth® protocol. That is, in one embodiment, the PAN radio communicates the second data with the second PAN radio using the Zigbee® technology and the WLAN radio communicates the first data with the third radio using the Wi-Fi® technology. In another embodiment, the PAN radio communicates the second data with the second PAN radio using the Bluetooth® technology and the WLAN radio communicates the first data with the third radio using the Wi-Fi® technology. The LoRa radio communicates the third data with the second LoRa radio using the specified protocols and frequency band for LoRa communications. Alternatively, other protocols can be used.

In this embodiment, the dual-band inverted-F antenna 502 is a coplanar 2D structure as illustrated in the top perspective view of FIG. 5. The 2D structure can wrap around different sides of the antenna carrier, an inner surface of a cover of the electronic device 500, or the like. In particular, in the depicted embodiment, the various elements of the dual-band inverted-F antenna 502 are disposed in a first plane (e.g., a back surface of a cover (not illustrated in FIG. 5) of the electronic device 500. In other embodiments, some portions of the dual-band inverted-F antenna 502 can be disposed in one or more additional planes. Also, as described above, these elements of the dual-band inverted-F antenna 502 can be disposed to be coplanar as a 2D structure that is bent or curved to correspond with a surface upon which dual-band inverted-F antenna 502 is disposed.

Strong resonances are not easily achieved within a compact space within user devices, especially within the spaces on consumer devices. The structure of the dual-band inverted-F antenna 502 provides strong resonances at a first frequency range of about 800-1000 MHz in the first mode and at a second frequency range of about 2.4 GHz to 2.7 GHz in the second mode. Strong resonances, as used herein, refer to a significant return loss at those frequency bands, which is better for impedance matching to 50-ohm systems. These multiple strong resonances can provide an improved antenna design as compared to conventional designs.

Figure 6:
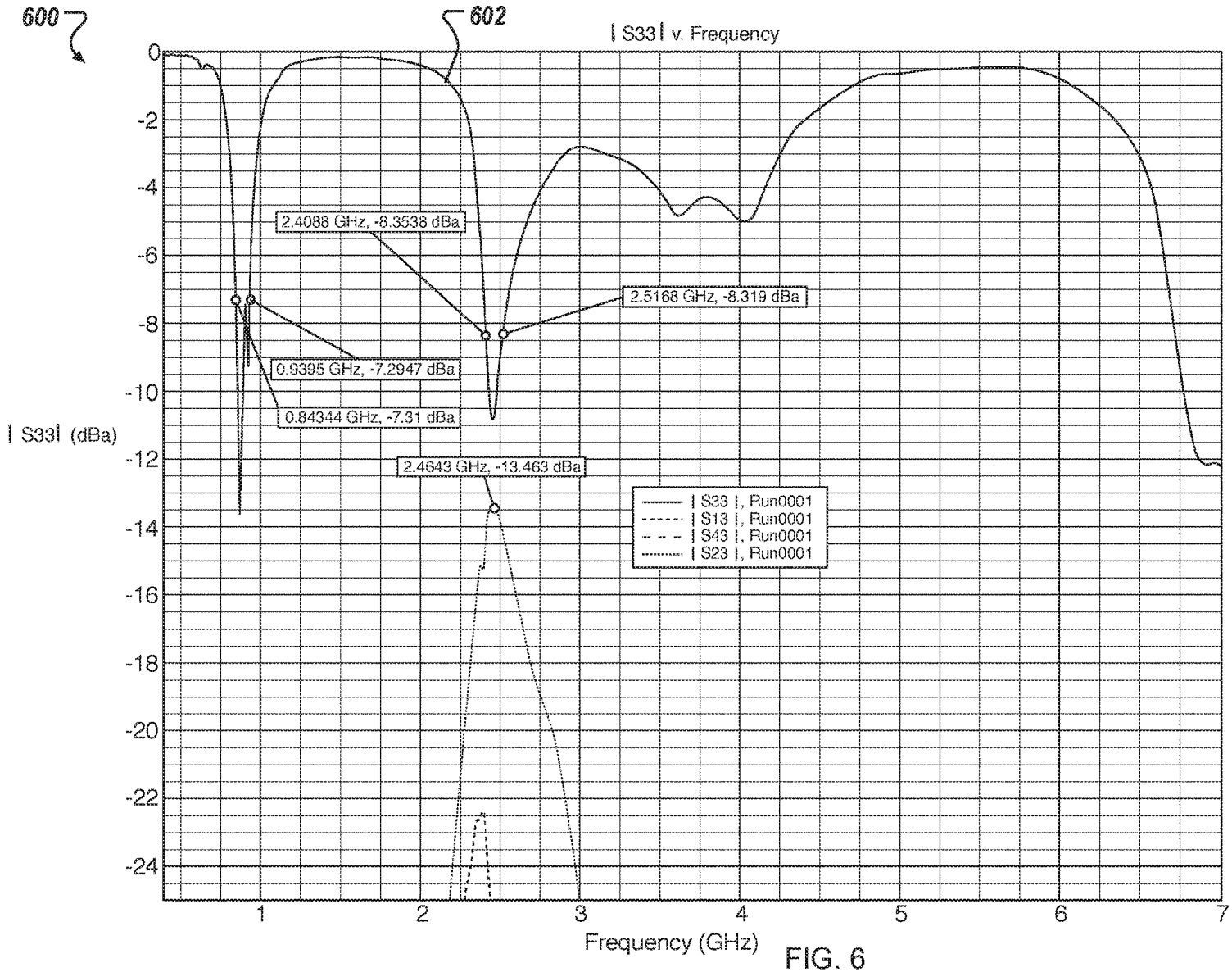
FIG. 6 is a graph of measured return loss of the dual-band inverted-F antenna of FIG. 4 according to one embodiment.

FIG. 6 is a graph of measured return loss of the dual-band inverted-F antenna of FIG. 4 according to one embodiment. The graph 600 shows the measured return loss 602 of the dual-band inverted-F antenna 400 of FIG. 4 to operate as a PAN antenna in a first resonant mode and as a LoRa antenna in a second resonant mode. Corresponding radios coupled to the dual-band inverted-F antenna 400 of FIG. 4 can operate simultaneously or concurrently given the isolation between the two resonant modes. More specifically, the dual-band inverted-F antenna 400 provides a resonant mode of those respective frequencies in the different modes of operation. That is, the dual-band inverted-F antenna 400 decreases the return loss at the corresponding frequencies to create or form a first resonance that sufficiently covers the 840 MHz to 930 MHz frequency range and a second resonance that sufficiently covers the 2.4 GHz to 2.5 GHz frequency range. As described herein, other resonant modes may be achieved. Also, other frequency ranges may be covered by different designs of the dual-band antenna. It should be noted that the terms "first," "second," "third," "fourth," etc. as used herein are meant as labels to distinguish among different elements and may not necessarily have an ordinal meaning according to their numerical designation.

Figure 7:
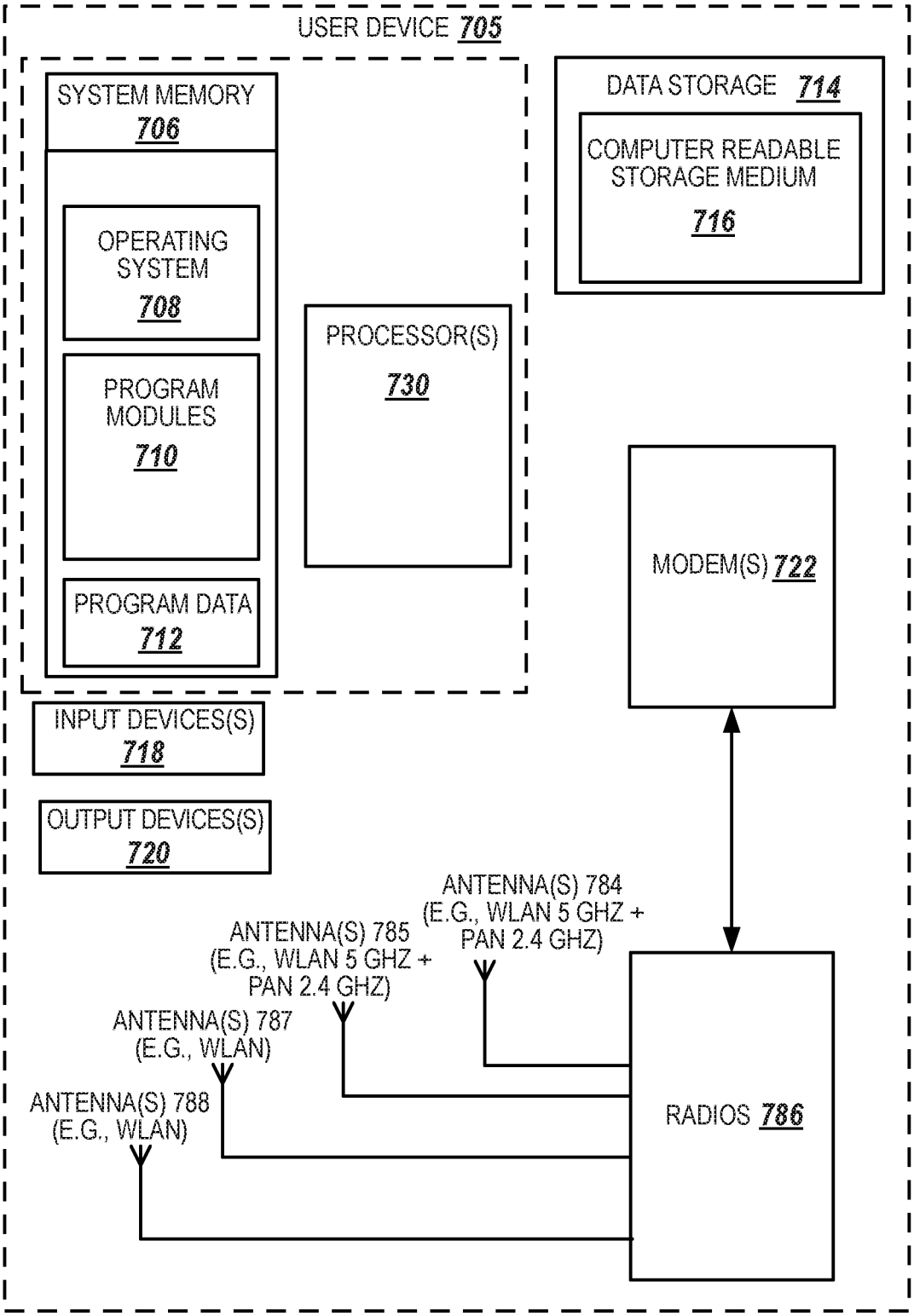
FIG. 7 is a block diagram of an electronic device in which embodiments of a dual-band antenna may be implemented.

FIG. 7 is a block diagram of an electronic device 705 in which embodiments of a dual-band antenna may be implemented. The electronic device 705 may correspond to the electronic device 200 of FIGS. 2A-2B or the electronic device 500 of FIG. 5. The electronic device 805 may be any type of computing device such voice control and speaker devices, televisions, television set top boxes, television dongles, an electronic book reader, a PDA, a mobile phone, a laptop computer, a portable media player, a tablet computer, a camera, a video camera, a netbook, a desktop computer, a gaming console, a DVD player, Blu-ray® player, a computing pad, a media center, an audio-input-enabled device, a speech-based personal data assistant, or the like. The electronic device 705 may be any portable or stationary user device. For example, the electronic device 705 may be an intelligent voice control and speaker system. Alternatively, the electronic device 705 can be any other device used in a WLAN network (e.g., Wi-Fi® network), a WAN network, or the like.

The electronic device 705 includes one or more processor(s) 730, such as one or more CPUs, microcontrollers, field programmable gate arrays, or other types of processing devices. The electronic device 705 also includes system memory 706, which may correspond to any combination of volatile and/or non-volatile storage mechanisms. The system memory 706 stores information that provides operating system component 708, various program modules 710, program data 712, and/or other components. In one embodiment, the system memory 706 stores instructions of the methods as described herein. The electronic device 705 performs functions by using the processor(s) 730 to execute instructions provided by the system memory 706.

The electronic device 705 also includes a data storage device 714 that may be composed of one or more types of removable storage and/or one or more types of non-removable storage. The data storage device 714 includes a computer-readable storage medium 716 on which is stored one or more sets of instructions embodying any of the methodologies or functions described herein. Instructions for the program modules 710 may reside, completely or at least partially, within the computer-readable storage medium 716, system memory 706 and/or within the processor(s) 730 during execution thereof by the electronic device 705, the system memory 706 and the processor(s) 730 also constituting computer-readable media. The electronic device 705 may also include one or more input devices 718 (keyboard, mouse device, specialized selection keys, etc.) and one or more output devices 720 (displays, printers, audio output mechanisms, etc.).

The electronic device 705 further includes a modem 722 to allow the electronic device 705 to communicate via a wireless network (e.g., such as provided by the wireless communication system) with other computing devices, such as remote computers, an item providing system, and so forth. The modem 722 can be connected to one or more radios 786. The radios may include a WLAN radio, a WAN radio, PAN radio, or the like, as described herein. Antennas are coupled to the radios 786, which are coupled to the modem 722. The antennas may include one or more dual-band antennas, as described herein, such as the WLAN 5 GHz plus PAN 2.4 GH antennas 784, 785, and the WLAN antennas 787, 788, or the like. Additional antennas may be used and may be GPS antennas, NFC antennas, other WAN antennas, or the like. The modem 722 allows the electronic device 705 to handle both voice and non-voice communications (such as communications for text messages, multimedia messages, media downloads, web browsing, etc.) with a wireless communication system. The modem 722 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 722 may generate signals and send these signals to antennas 784, 785, 787, and 788, via RF radio(s) 786 as descried herein. Electronic device 705 may additionally include a WLAN radio, a GPS receiver, a PAN transceiver, and/or other RF radios. These RF radios may additionally or alternatively be connected to one or more of antennas 784, 785, 787, and 788. Antennas 784, 785, 787, and 788 may be configured to transmit in different frequency bands and/or using different wireless communication protocols. The antennas 784, 785, 787, and 788 may be directional, omnidirectional, or non-directional antennas. In addition to sending data, antennas 784, 785, 787, and 788 may also receive data, which is sent to appropriate RF radios connected to the antennas.

In one embodiment, the electronic device 705 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 722 is shown to control transmission and reception via antenna, the electronic device 705 may alternatively include multiple modems, each of which is configured to transmit/receive data via a different antenna and/or wireless transmission protocol.

The electronic device 705 delivers and/or receives items, upgrades, and/or other information via the network. For example, the electronic device 705 may download or receive items from an item providing system. The item providing system receives various requests, instructions and other data from the electronic device 705 via the network. The item providing system may include one or more machines (e.g., one or more server computer systems, routers, gateways, etc.) that have processing and storage capabilities to provide the above functionality. Communication between the item providing system and the electronic device 705 may be enabled via any communication infrastructure. One example of such an infrastructure includes a combination of a wide area network (WAN) and wireless infrastructure, which allows a user to use the electronic device 705 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by products using the Wi-Fi® technology based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the electronic device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The electronic devices are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The electronic devices may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present embodiments as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a wireless dual-band local area network (WLAN) radio that operates at the 2.45 GHz frequency band and the 5 GHz frequency band;

a personal area network (PAN) radio that operates at the 2.45 GHz frequency band;

a diplexer coupled to the WLAN radio and the PAN radio;

a single coaxial radio frequency (RF) feed line coupled to the diplexer; and a dual-band antenna comprising:

a RF feed coupled to the single coaxial RF feed line;

a ground element;

a resonating arm;

a shorting arm coupled between the ground element and the resonating arm at a first side of the dual-band antenna;

a resonating T-shaped structure coupled to a first side of the resonating arm at the RF feed, the resonating T-shaped structure comprising a first base element that extends out from the first side of the resonating arm, a first arm that extends in a first direction away from the first base element, and a second arm that extends in a second direction away from the first base element, wherein the first arm forms a first gap between the resonating T-shaped structure and the resonating arm and the second arm forms a second gap between the resonating T-shaped structure and the resonating arm; and a bowtie-shaped structure coupled to a second side of the resonating arm at the RF feed, the bowtie-shaped structure comprising a second base element that extends out from the second side of the resonating arm, a first tapered element that extends in the first direction away from the second base element, and a second tapered element that extends in the second direction away from the second base element, wherein the WLAN radio communicates data with a second WLAN radio of a second device by radiating electromagnetic energy at the 5 GHz frequency band via the dual-band antenna, wherein the PAN radio communicates data with a second PAN radio of a third device by radiating electromagnetic energy at the 2.45 GHz frequency band via the dual-band antenna.

2. The electronic device of claim 1, further comprising flexible circuit board, wherein the dual-band antenna is printed as a single copper layer on the flexible circuit board.

3. The electronic device of claim 1, wherein the PAN radio communicates data with the second PAN radio using at least one of the Zigbee® protocol according to the IEEE 802.15.4 specification or the Bluetooth® protocol.

4. An electronic device comprising:

a single coaxial radio frequency (RF) feed line; and a dual-band antenna comprising:

a RF feed coupled to the single coaxial RF feed line;

a ground element;

a first arm;

a shorting arm coupled between the ground element and the first arm at a first side of the dual-band antenna;

a dual-arm structure coupled to a first side of the first arm at the RF feed, the dual-arm structure comprising a first base element that extends out from the first side, a first arm that extends in a first direction away from the first base element, and a second arm that extends in a second direction away from the first base element, wherein the first arm forms a first gap between the dual-arm structure and the ground element and the second arm forms a second gap between the dual-arm structure and the ground element; and a dual-element structure coupled to a second side of the first arm at the RF feed, the dual-element structure comprising a second base element that extends out from the second side, a first tapered element that extends in the first direction away from the second base element, and a second tapered element that extends in the second direction away from the second base element.

5. The electronic device of claim 4, further comprising flexible circuit board coupled to a surface of a housing of the electronic device, wherein the dual-band antenna is printed on a single layer of the flexible circuit board.

6. The electronic device of claim 5, further comprising:

a first radio;

a second radio; and a diplexer coupled to the first radio, the second radio, and the dual-band antenna, wherein the first radio is to communicate first data with a third radio of a second device in a first frequency band, wherein the second radio is to communicate second data with a fourth radio of a third device in a second frequency band;

a housing;

a first circuit board disposed within the housing, wherein the first radio, the second radio, and the diplexer are disposed on the first circuit board; and a second circuit board disposed within the housing, wherein the dual-band antenna is printed on the second circuit board.

7. The electronic device of claim 4, further comprising:

a second antenna; and a circuit board, wherein the dual-band antenna and the second antenna are printed on the circuit board.

8. The electronic device of claim 4, further comprising:

a first radio;

a second radio; and a diplexer coupled to the first radio, the second radio, and the dual-band antenna, wherein the first radio is to communicate first data with a third radio of a second device in a first frequency band, wherein the second radio is to communicate second data with a fourth radio of a third device in a second frequency band.

9. The electronic device of claim 8, wherein the first radio is a wireless local area network (WLAN) radio that operates at the 5 GHz frequency band, wherein the second radio is a personal area network (PAN) radio that operates at the 2.45 GHz frequency band.

10. The electronic device of claim 9, wherein the PAN radio is to communicate the second data with the fourth radio using the Zigbee® technology, wherein the WLAN radio is to communicate the first data with the third radio using the Wi-Fi® technology.

11. The electronic device of claim 9, wherein the PAN radio is to communicate the second data with the fourth radio using the Bluetooth® technology, wherein the WLAN radio is to communicate the first data with the third radio using the Wi-Fi® technology.

12. The electronic device of claim 4, wherein the first arm is a conductive line, wherein the second arm comprises a first section, a second section, and a third section, wherein the first section extends in the second direction from the first base element at a proximal end of the first section to a distal end of the first section, wherein the second section extends in a third direction from the distal end of the first section at a proximal end of the second section to a distal end of the second section, the third direction being perpendicular to the second direction, wherein the third section extends in the second direction from the distal end of the second section at a proximal end of the third section to a distal end of the third section, wherein the proximal end of the first section corresponds to a proximal end of the second arm and the distal end of the third section corresponds to a distal end of the second arm.

13. The electronic device of claim 4, wherein:

the first tapered element has a proximal end and a distal end, wherein a first height of the first tapered element at the distal end of the first tapered element is greater than a second height of the first tapered element at the proximal end of the first tapered element; and the second tapered element has a proximal end and a distal end, wherein a first height of the second tapered element at the distal end of the second tapered element is greater than a second height of the second tapered element at the proximal end of the second tapered element.

14. The electronic device of claim 13, wherein the first height of the first tapered element is greater than the first height of the second tapered element.

15. The electronic device of claim 4, wherein the first base element has a first width and the second base element has a second width, wherein the second width is greater than the first width.

16. An electronic device comprising:

a speaker;

a first circuit board comprising at least one microphone;

a second circuit board comprising a first 2×2 wireless local area network (WLAN) radio, a second 2×2 WLAN radio, a diplexer, and a personal area network (PAN) radio;

a first WLAN antenna coupled to the first 2×2 WLAN radio;

a second WLAN antenna coupled to the first 2×2 WLAN radio; and a dual-band antenna coupled to the second 2×2 WLAN radio and the PAN radio via the diplexer, wherein the dual-band antenna comprises a RF feed coupled to the diplexer;

a ground element;

a first arm;

a shorting arm coupled between the ground element and the first arm at a first side of the dual-band antenna;

a dual-arm structure coupled to a first side of the first arm at the RF feed, the dual-arm structure comprising a first base element that extends out from the first side, a first arm that extends in a first direction away from the first base element, and a second arm that extends in a second direction away from the first base element, wherein the first arm forms a first gap between the dual-arm structure and the ground element and the second arm forms a second gap between the dual-arm structure and the ground element; and a dual-element structure coupled to a second side of the first arm at the RF feed, the dual-element structure comprising a second base element that extends out from the second side, a first tapered element that extends in the first direction away from the second base element, and a second tapered element that extends in the second direction away from the second base element.

17. The electronic device of claim 16, wherein the first WLAN antenna and the second WLAN antenna are disposed on the second circuit board, and wherein the dual-band antenna is disposed on a flexible circuit board that is coupled to a surface of a housing of the electronic device.

18. The electronic device of claim 16, wherein the second WLAN radio operates at the 5 GHz frequency band, wherein the PAN radio operates at the 2.45 GHz frequency band.

19. The electronic device of claim 18, wherein the second WLAN radio is to communicate first data with a third radio of a second device using the Wi-Fi® technology, and wherein the PAN radio is to communicate second data with a fourth radio of a third device using the Zigbee® technology.

20. The electronic device of claim 18, wherein the second WLAN radio is to communicate first data with a third radio of a second device using the Wi-Fi® technology, and wherein the PAN radio is to communicate second data with a fourth radio of a third device using the Bluetooth® technology.

* * * * *